US011131307B2

(12) United States Patent
Mahalatkar et al.

(10) Patent No.: US 11,131,307 B2
(45) Date of Patent: Sep. 28, 2021

(54) HYBRID PROFILE SUPERCHARGER ROTORS

(71) Applicant: EATON INTELLIGENT POWER LIMITED, Dublin (IE)

(72) Inventors: Kartikeya K Mahalatkar, Pune (IN); Pavan Chandras, Pune (IN); Matthew G Swartzlander, Battle Creek, MI (US); Rajeshekhar G Bagalakoti, Belagavi (IN); Daniel Ouwenga, Portage, MI (US); Sneha Abhyankar, Kharadi (IN)

(73) Assignee: Eaton Intelligent Power Limited, Dublin (IE)

( * ) Notice: Subject to any disclaimer, the term of this patent is extended or adjusted under 35 U.S.C. 154(b) by 350 days.

(21) Appl. No.: 15/753,295

(22) PCT Filed: Aug. 16, 2016

(86) PCT No.: PCT/US2016/047225
§ 371 (c)(1),
(2) Date: Feb. 17, 2018

(87) PCT Pub. No.: WO2017/031134
PCT Pub. Date: Feb. 23, 2017

(65) Prior Publication Data

US 2018/0245590 A1 Aug. 30, 2018

(30) Foreign Application Priority Data

Aug. 17, 2015 (IN) ..... 2530/DEL/2015

(51) Int. Cl.
*F04C 18/16* (2006.01)
*F04C 18/08* (2006.01)

(52) U.S. Cl.
CPC ..... *F04C 18/16* (2013.01); *F04C 18/084* (2013.01); *F04C 2250/20* (2013.01)

(58) Field of Classification Search
CPC .... F04C 18/084; F04C 18/16; F04C 2250/20; F04C 2/16
See application file for complete search history.

(56) References Cited

U.S. PATENT DOCUMENTS 4,224,015 A 9/1980 Nagata
4,975,032 A 12/1990 Arai et al.
(Continued)

FOREIGN PATENT DOCUMENTS

CN 202520550 U 11/2012
CN 203130514 U 8/2013
(Continued)

OTHER PUBLICATIONS

Written Opinion and International Search Report for PCT/US2016/047225 dated Oct. 12, 2016, pp. 1-15.
(Continued)

*Primary Examiner* — Mary Davis
(74) *Attorney, Agent, or Firm* — Mei & Mark, LLP

(57) ABSTRACT

A supercharger rotor comprising a plurality of lobes around a center axis, each lobe of the plurality of lobes comprising a rotor profile. The rotor profile comprises a tip, a convex addendum comprised of at least two interpolated and stitched spline curves, an undercut region, and a root base.

24 Claims, 16 Drawing Sheets

(56) References Cited

U.S. PATENT DOCUMENTS

| | | | | |
|---|---|---|---|---|
| 5,336,069 | A * | 8/1994 | Matsuyama | F04C 18/084 418/150 |
| 6,116,879 | A | 9/2000 | Teraoka | |
| 7,488,164 | B2 | 2/2009 | Swartzlander | |
| 7,866,966 | B2 | 1/2011 | Swartzlander | |
| 7,997,885 | B2 | 8/2011 | Allum | |
| 8,425,212 | B2 | 4/2013 | Ono et al. | |
| 8,784,087 | B2 | 7/2014 | Hirano et al. | |
| 8,827,668 | B2 * | 9/2014 | Giuseppe | F04C 2/16 418/150 |
| 2003/0231972 | A1 * | 12/2003 | Morselli | F04C 2/084 418/206.5 |
| 2010/0254846 | A1 | 10/2010 | Hirano et al. | |
| 2010/0307234 | A1 | 12/2010 | Ono et al. | |
| 2015/0211517 | A1 * | 7/2015 | Matsui | F04C 18/16 418/206.6 |

FOREIGN PATENT DOCUMENTS

| | | | |
|---|---|---|---|
| CN | 203201803 | U | 9/2013 |
| EP | 1371848 | B1 | 1/2006 |
| JP | H11230067 | A | 8/1999 |
| JP | 2004278350 | A | 10/2004 |
| JP | 2008196353 | A | 8/2008 |

OTHER PUBLICATIONS

Chapter 14, "Spline Curves," pp. 87-103; first downloaded Aug. 10, 2015, also downloaded Jun. 3, 2020 from https://people.cs.clemson.edu/~dhouse/courses/405/notes/splines.pdf.

* cited by examiner

INVOLUTE ROTOR

| | 4 LOBE INVOLUTE | 5 LOBE INVOLUTE | 5 LOBE INVOLUTE |
|---|---|---|---|
| CENTER DISTANCE (mm) | 58.42 | 58.42 | 60.65 |
| DISPLACEMENT (cc) | 726 | 726 | 726 |
| ROTOR-ROTOR LEAKAGE LENGTH (mm) | 392 | 558 | 495 |
| PROFILE VIEW |   |   |   |

HYBRID PROFILE ROTORS

| | 5 LOBE CYCLOID | 5 LOBE CYCLOID |
|---|---|---|
| CENTER DISTANCE (mm) | 58.42 | 60.65 |
| DISPLACEMENT (cc) | 726 | 726 |
| ROTOR-ROTOR LEAKAGE LENGTH (mm) | 494 | 397 |
| PROFILE VIEW |   |   |

HYBRID PROFILE SUPERCHARGER ROTORS

This is a § 371 Application of PCT/US2016/047225 filed Aug. 16, 2016 and claims the benefit of Indian Provisional Application No. 2530/DEL/2015, filed Aug. 17, 2015, all of which are incorporated herein by reference.

FIELD

This application provides hybrid rotor blade profiles for Roots superchargers.

BACKGROUND

Current involute rotor profiles have backwards leakage of air flow caused in part by a gap between a first rotor's tip and a second rotor's root, shown in FIG. 1. If another profile is used, such as a cycloid profile, a large gap between rotors must be maintained, as shown in FIGS. 3A & 5. Attempting to close the gap results in a large contact area, as shown in FIGS. 3B & 7. Thus, the prior art has unsatisfactory tradeoffs between rotor contact area and backwards leaking of air. Examples of involute and cycloidal superchargers can be seen in U.S. Pat. Nos. 7,488,164, 4,975,032, and 7,997,885.

SUMMARY

The methods and devices disclosed herein overcome the above disadvantages and improves the art by way of a hybrid profile for a supercharger rotor. The hybrid profile improves volumetric efficiency by reducing the total area over which leakage occurs.

A supercharger rotor blade profile comprises a cycloid curve modified with at least two interpolated and stitched spline curves. The supercharger rotor blade profile further comprises a flattened tip.

A supercharger rotor comprising a plurality of lobes around a center axis, each lobe of the plurality of lobes comprising a rotor profile. The rotor profile comprises a tip, a convex addendum comprised of at least two interpolated and stitched spline curves, an undercut region, and a root base.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 1:
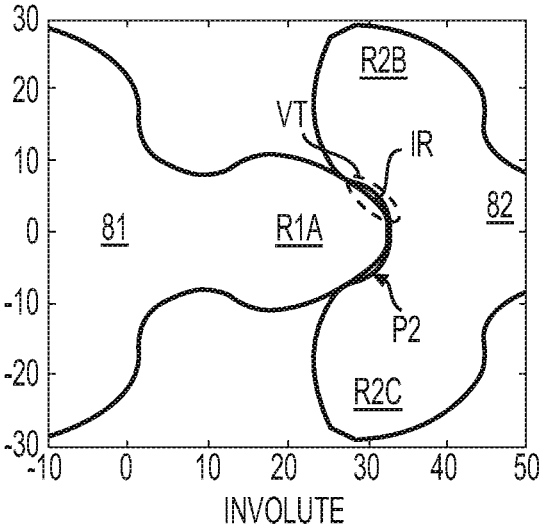
FIG. 1 (PRIOR ART)
FIG. 1 is a view of a prior art pair of involute supercharger rotors.

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures. Rotor lobes can be various dimensions, and so reference to the Z axis as a "long axis" or "length axis" may result in the Z axis being longer than the X or Y axis, and so be true with respect to the figure. But in implementation, the Y axis could be longer than the Z axis, or, the X axis longer than the Z axis, or the Y axis longer than the X axis. So, it is a matter of convenience to provide relative axial references and discuss the Z2, Z3, Z4, Z20, Z30, Z40 axis as length, the Y2, Y3 axis as height, and the X2, X3 axis as width.

A Roots style supercharger 101 can have two rotors 1000, 2000 within a housing 201. The rotors 1000, 2000 are designed to move a fluid, such as air, from an inlet 100 to an outlet 200. The illustrated housing is an "axial inlet, radial outlet" style housing, with intake fluid coming in to the housing 201 along the length axis Z2 of the rotor. As the rotors 1000, 2000 rotate, fluid is moved towards the outlet 200 and leaves the housing 201 in the radial direction, ideally in planes parallel to the height axis Y2 of the blades. Other types of housings, such as the "radial inlet, radial outlet" style shown in FIG. 3E, can be used, and so the illustrated housing 201 is not limiting of the housing profiles. In this disclosure, the rotor mounting techniques can also vary, and other gear, bearing plate, and bearing combinations can be used with the rotor profiles.

The twist angle of the blades can vary from zero degrees (parallel lobes) up to a maximum twist MaxTwist in response to variables such as housing style used, or in response to pressure ratio or flow volume parameters. The maximum twist MaxTwist can be according to equation 1:

$$\text{Max Twist} = 360° - 2\cos^{-1}\left(\frac{CD}{OD}\right) - \left(\frac{360°}{N}\right) \qquad \text{eq. 1}$$

In equation 1, CD is the center distance between rotor shafts, OD is the rotor outer diameter, and N is the number of lobes. Equation 1 ensures that there is no direct leakage path between the outlet and inlet of the housing.

Figure 9:
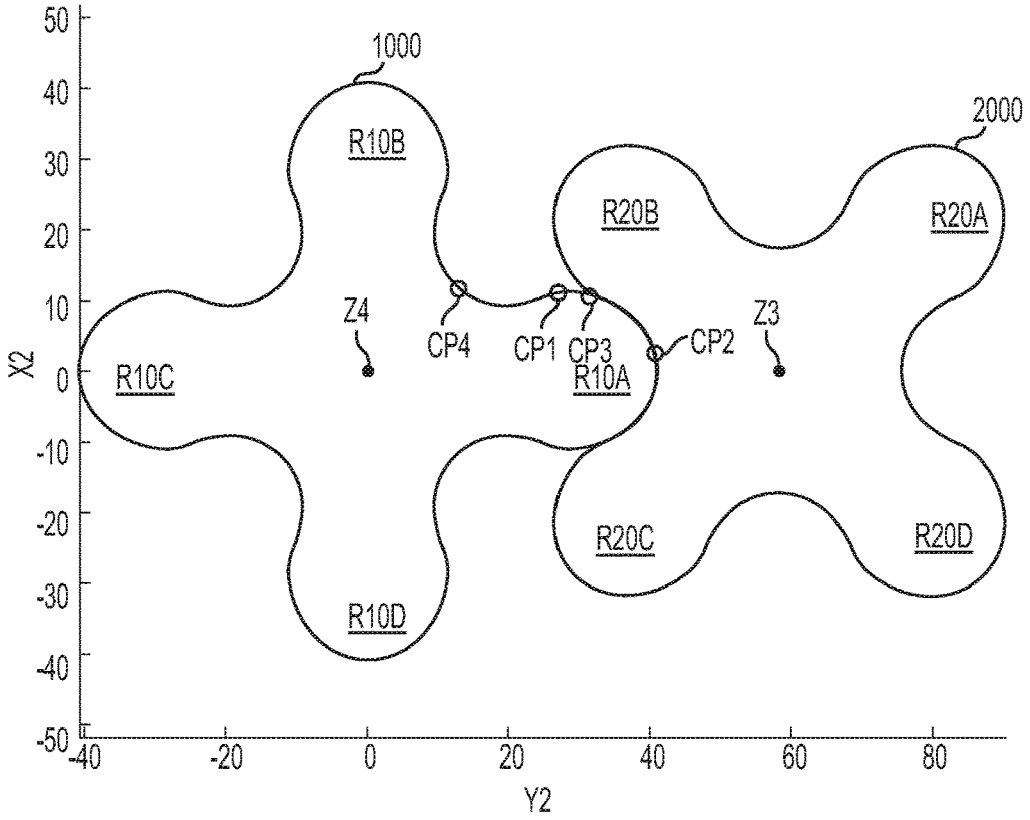
FIGS. 9-24 further detail the hybrid profile rotors and blade profiles.
Figure 13:
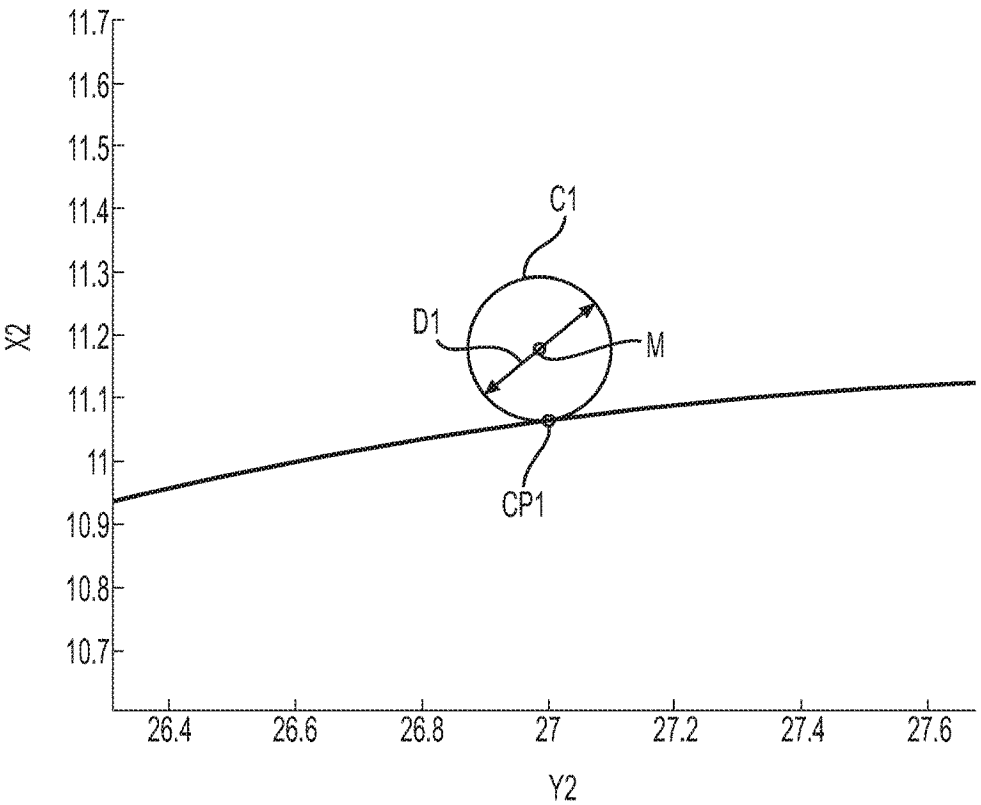

The rotors have blades R10A, R20B, R20C, varying in number from two to six or more, with three blades being illustrated in FIGS. 4A-4D, four blades being illustrated in FIGS. 9 & 13, and six blades being illustrated in FIG. 17C. The blades can twist along the length axis Z2, Z3, Z4 of the rotors. The rotors are aligned to blow a fluid, such as air, through the housing by scooping the fluid in gaps between the blades, sweeping the fluid within the housing 201, and expelling the fluid out outlet 200. One rotor turns clockwise, while the other turns counterclockwise. At the center of the Roots device, a blade tip T1 of the first rotor blade R10A meshes into the undercut U2 between rotor blades R20B, R20C of the second rotor 2000.

In prior art devices, a large gap must be kept between the rotors 81, 82 because the rotors are prone to contact each other. For example, a rotor blade R1A can contact the surface of rotor blade R2B or R2C, or can contact the root IR between rotor blades R2B and R2C. The contact length CL1 is illustrated by the jagged line in FIG. 3B. The new blade profile reduces by 15-30% the contact length to CL20, shown in FIG. 4B. The sealing width SW2 is also indicated.

Figure 2:
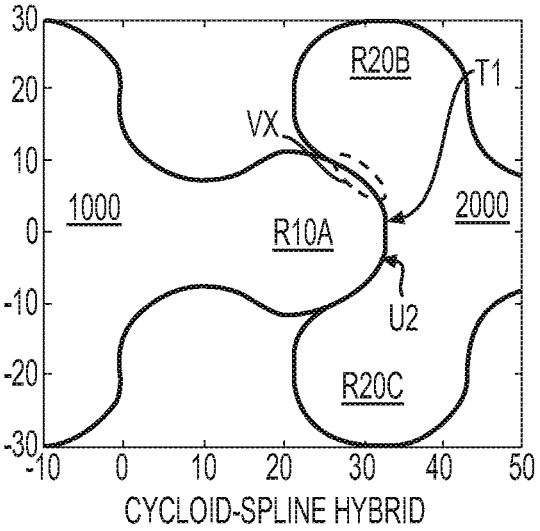
FIG. 2 is a view of a pair of hybrid profile supercharger rotors.
Figure 3A:
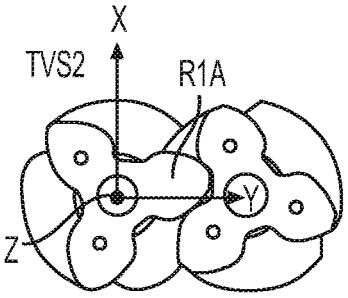
FIG. 3A (PRIOR ART)
FIGS. 3A-3E are additional views detailing prior art involute supercharger rotors.
Figure 3B:
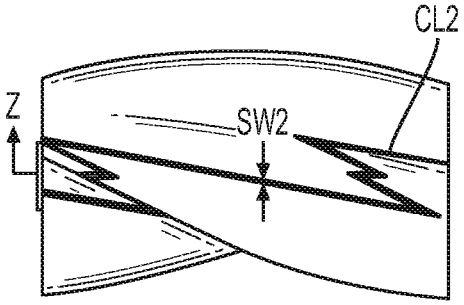
FIG. 3B (PRIOR ART)
Figure 3C:
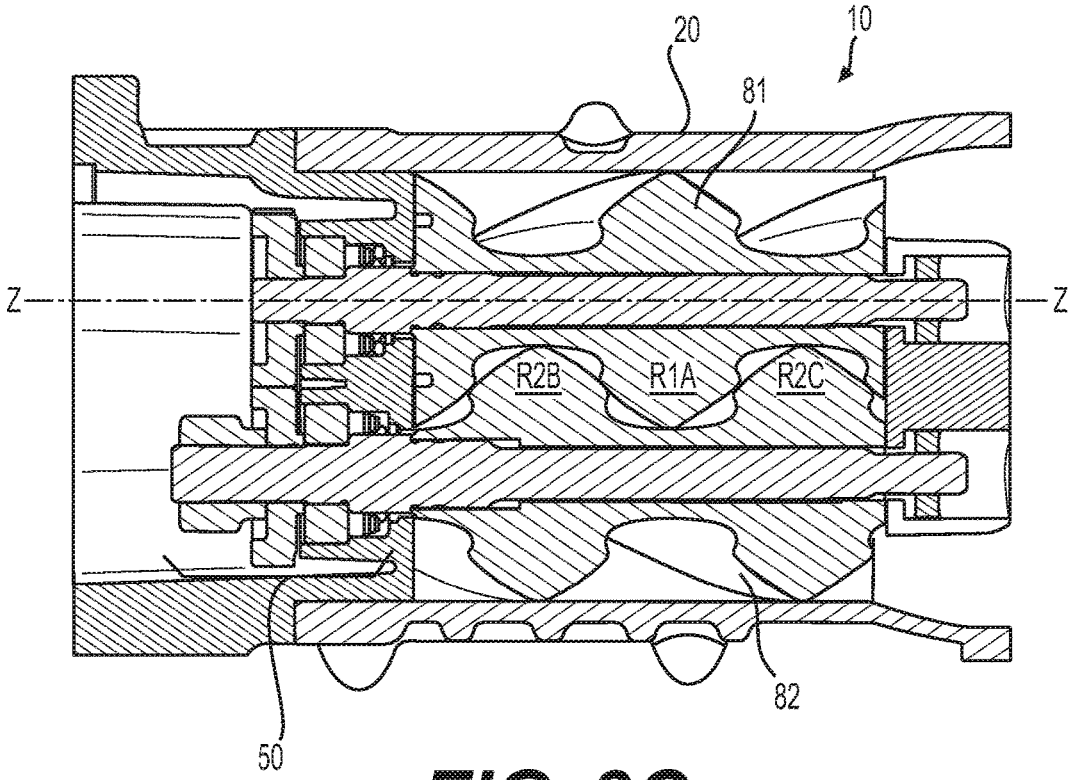
FIG. 3C (PRIOR ART)
Figure 3D:
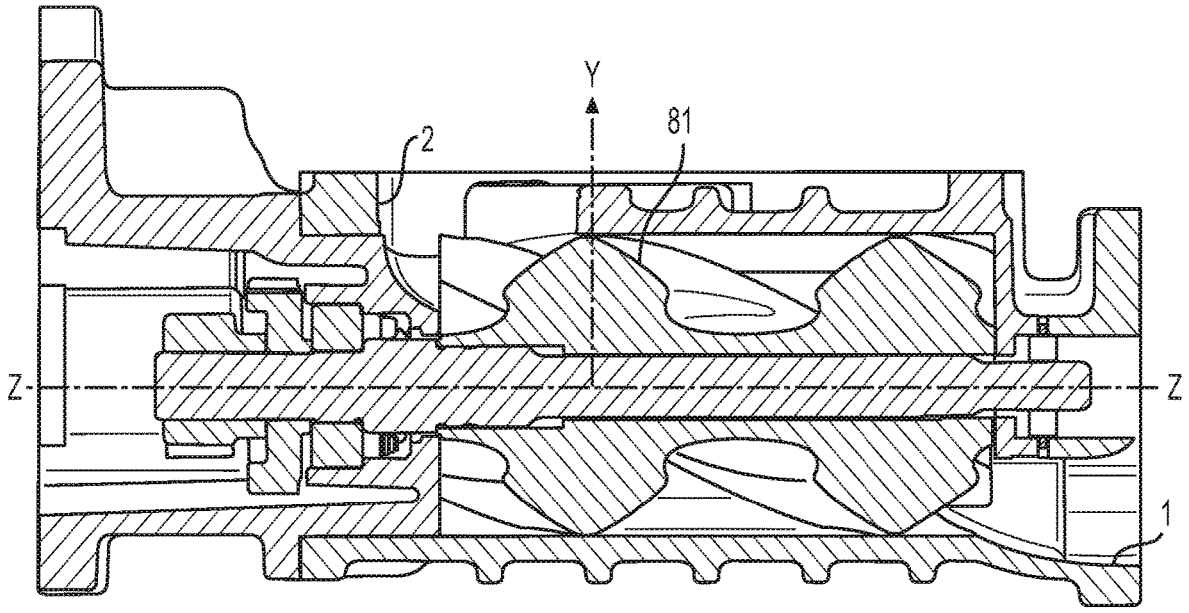
FIG. 3D (PRIOR ART)
Figure 3E:
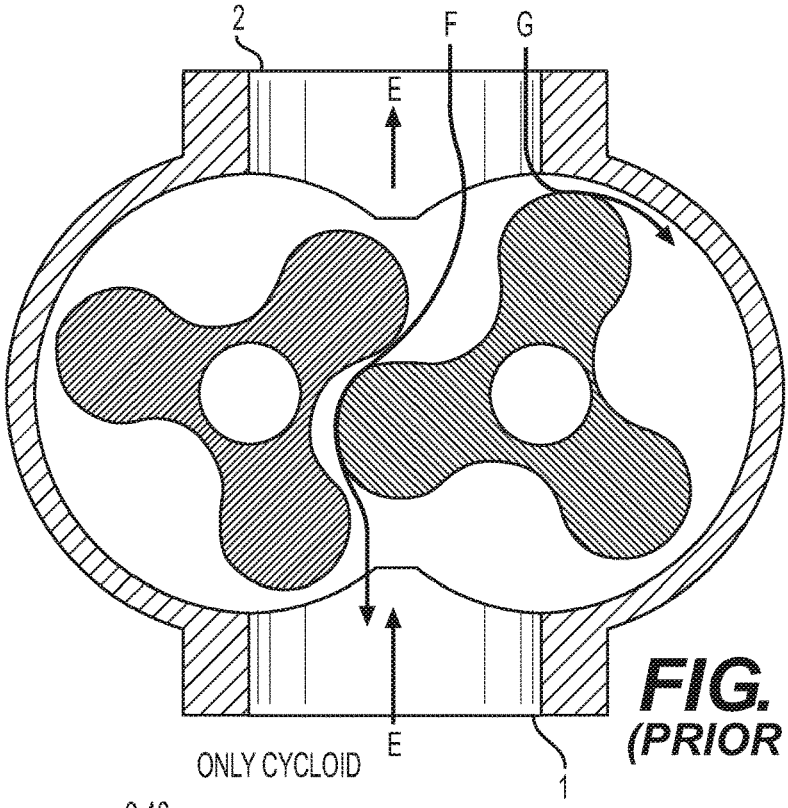
FIG. 3E (PRIOR ART)

The large gap between rotors 81 & 82 permits leakage of fluid from the outlet side of the device towards the inlet side, as shown in FIG. 3E. Instead of fluid moving along flow path E (bold arrows), the fluid flows backwards along paths F & G (bold arrows). The gap also results in a trapped volume VT, which can be seen in the circled area of FIG. 1. The fluid is trapped in a pocket P2 between the rotor blades, and the fluid can be squeezed or pushed backwards from outlet 2 to inlet 1. Using the new blade profile reduces the issue. The trapped volume VT is no longer "trapped." It is eliminated in favor of a small gap corresponding to the nominal rotor-to-rotor clearance, or non-trapped volume VX, shown in FIGS. 2 & 4C. The significant reduction in contact length and significant reduction in the gap between rotors 1000 & 2000 improves volumetric efficiency by 5-6% or more. The supercharger 101 has improved isentropic efficiency, improved pressure ratio capability, reduced NVH (noise, vibration, harshness), and improves over prior art volumetric leakage. The isentropic efficiency improvements are more dramatic over the prior art at high speeds.

Figure 5:
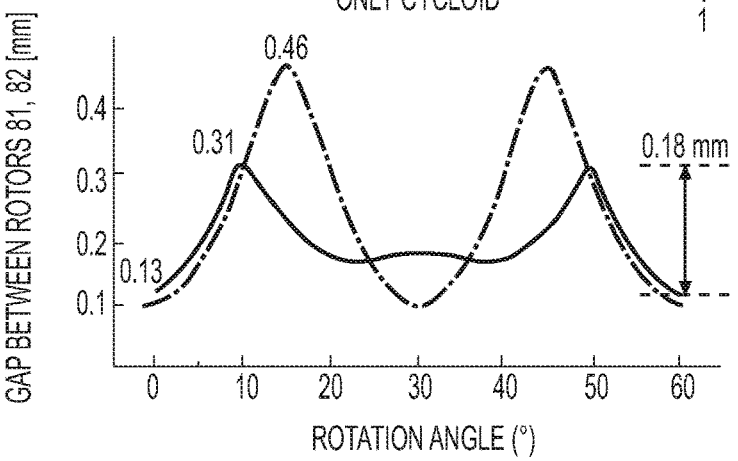
FIG. 5 (PRIOR ART)
FIG. 5 is a graph of a prior art variation in in a gap between a rotor blade and an adjacent rotor root pocket.

Prior art attempts to reduce the large gap have included applying a radius to an intersection between a concave arc and a convex arc of the blade profile. However, this correction causes an unreliable amount of backwards leaking because the gap between the rotor blade and the corresponding root varies dramatically as the rotors spin, as shown in FIG. 5. The prior art design has variations in the gap, in millimeters, between the rotors 81, 82 as the rotational (angular) position of the rotors changes in degree. The gap can vary from 0.10 mm to 0.46 mm as the rotation angle changes. Another gap can vary from 0.13 mm between rotors to 0.31 mm as the rotors 81, 82 rotate with respect to one another. The variation in actual gap between rotors for the prior art example is a nominal gap of 0.18 millimeters (180 microns).

Figure 6:
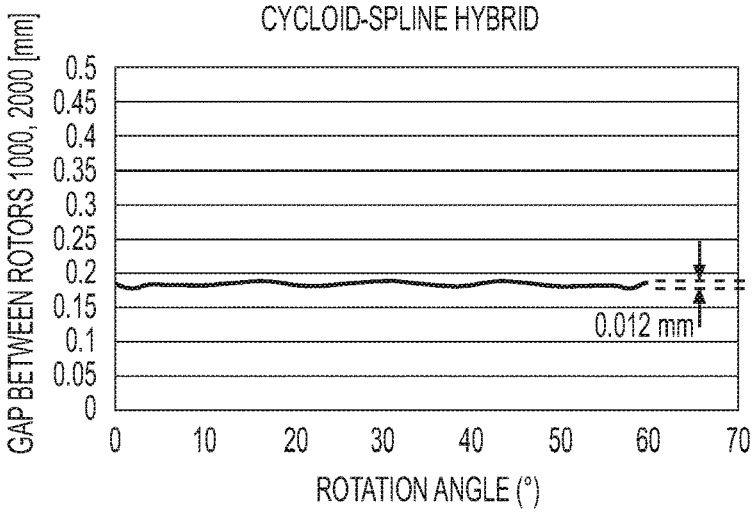
FIG. 6 is a graph of a variation in in a gap between a rotor blade and an adjacent rotor root pocket using the hybrid blade profile.

It is preferable to eliminate the backwards leaking and to provide a more uniform clearance between the rotor blades and root base RB, as shown in FIG. 6. The blade profile disclosed herein has a more uniform clearance over the prior art, a full factor of ten better than the prior art. The desired gap between rotors can be selected in view of design considerations to be, for example, 0.18 mm. But, with the hybrid rotor blade profile disclosed, the variation in the actual gap between rotors 1000 & 2000 can be reduced to a nominal gap of 0.012 mm. The variation in actual gap between rotors during rotation angle change is less than 10% of the desired actual gap, preferably less than 7% of the desired actual gap, and more preferably less than 3%. The vertical axis is in millimeters, and the horizontal axis is degrees of relative rotation of the rotors about the Z or Z2 axis. A designer can select a spacing between rotors 1000, 2000 to account for heat expansion and material properties. By applying the disclosed blade profiles, the gap between the rotors only varies by 0.012 mm (12 microns) during rotor rotation. The nominal gap is maintained, and so too the non-trapped volume VX. The fluid flow through the device is more predictable and uniform, and the backwards leaking issues in the prior art are substantially eliminated. Note that the actual gap can vary depending on manufacturing tolerances, and so the values shown are demonstrative rather than restrictive.

FIGS. 2, 4A-4D & 9-26 illustrate aspects of hybrid profile supercharger rotors comprising blade profiles of the cycloid type and incorporating spline curves on the blade profiles. The hybrid profile of the blades is formed by combining a cycloid shape with at least two spline curves S1, S2, S3 on each rotor blade R10A, R20B, R20C, . . . . At least two spline curves S1, S2 are applied at a convex transition zone TZ between the tip T1 of the blade and a concave undercut U1. At least a third spline curve S3 can be applied in the undercut U1.

FIG. 9 shows a pair of rotors 1000, 2000 relative to one another on and axis centered on the length axis Z2. Rotor height Y2 is shown on the horizontal axis, and the rotor width X2 is shown on the vertical axis, with relative units for convenience of reference. Rotor 1000 has rotor blade R10A meshed between rotor blades R20B & R20C of rotor 2000. Length axis Z3 is shown for rotor 2000. Control points CP1, CP2, CP3 & CP4 are indicated on rotor 1000.

Figure 10:
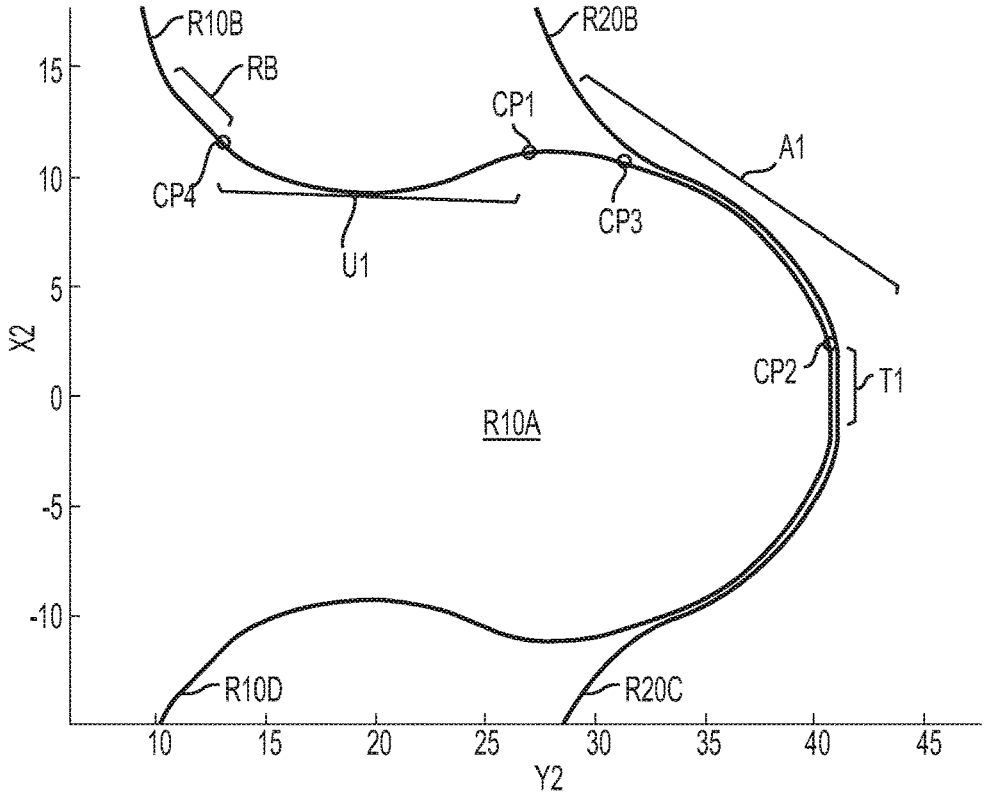

FIG. 10 zooms in on rotor blade R10A to explain the features of the hybrid profile rotor blade. A root base RB is shown adjoining rotor blade R10B. An undercut U1 adjoins root base RB. An convex addendum A1 adjoins the root base RB. In the example, a first control point CP1 is placed at the terminus of the undercut U1 to begin a convex addendum A1. As discussed with FIG. 13, the first control point CP1 can be selected at other than the terminus of the undercut U1. A second control point CP2 is placed at the terminus of the addendum A1, and at least a third control point CP3 is within the addendum A1. Additional control points can be placed within the addendum A1, as illustrated by the plus, triangle and X marks in FIG. 16. The locations of the control points minimize the leakage along contact length CL20. A tip T1 is at the end of the rotor blade R10A. The profile is a mirror image on the lower side, having an addendum adjoining the tip T1, and undercut adjoining the addendum, and a root base between the undercut and the adjoining rotor blade R10D.

Figure 11:
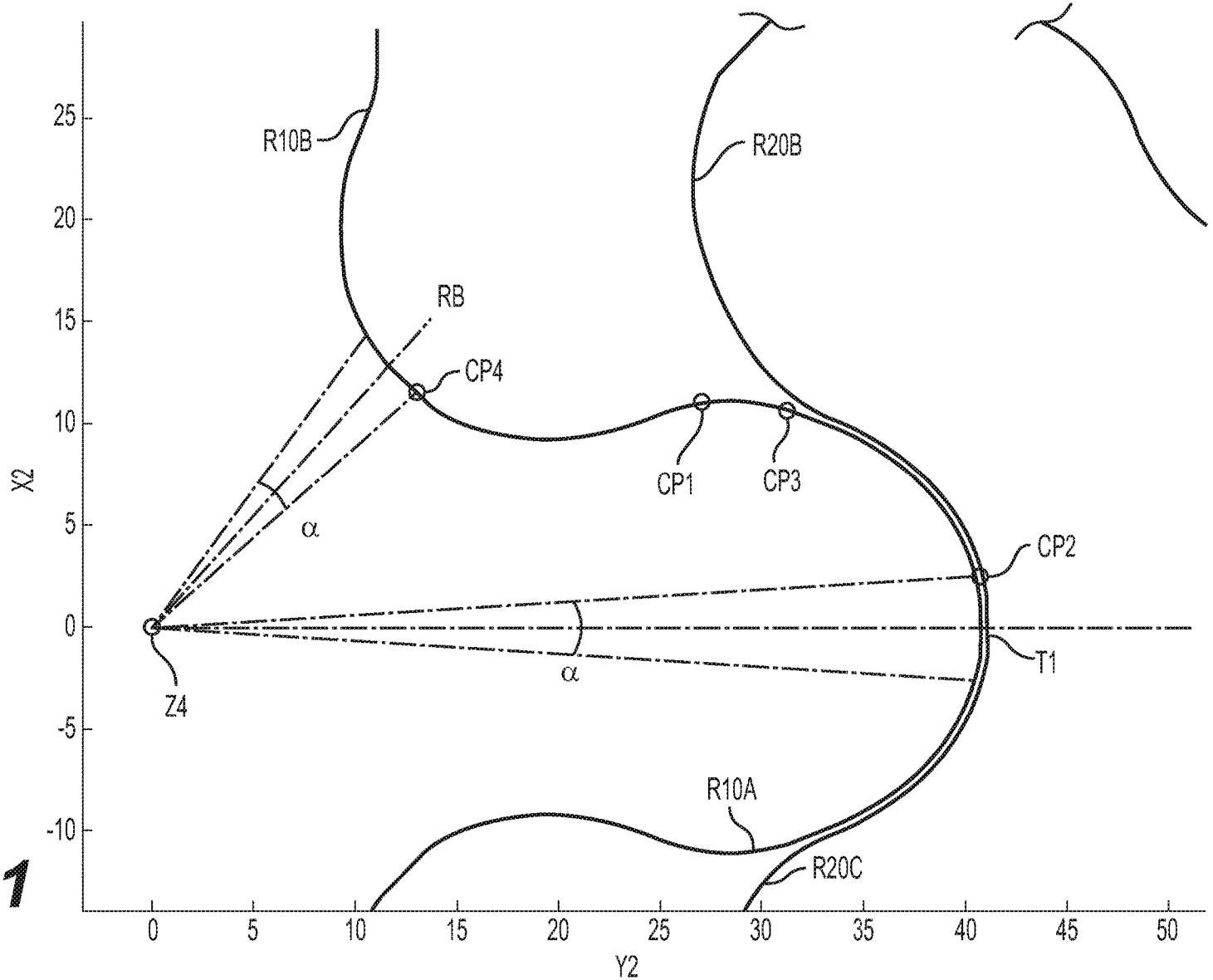

As shown in FIG. 11, the root base RB spans for a distance enclosed within a circular arc having an included angle alpha ($\alpha$) extending from the length axis Z2. The root base spans from root control point CP4 to the start of the adjoining rotor blade, which also comprises a root base.

The tip T1 also spans for a distance enclosed within a circular arc having the included angle alpha ($\alpha$) extending from the length axis Z2. The tip T1 is between mirror image addendums of the rotor blade. The tip T1 can be convex. But, unlike prior art cycloid rotors, the instant rotors can have flattened tips T1.

The supercharger rotor blade profile comprises a cycloid curve overlaid with at least two spline curves S1, S2. The blade profile can comprise a mirror image about a height axis Y2, so as to comprise at least four spline curves: at least two on each side of the height axis Y2.

The addendum A1 has a profile generated using the control points CP1, CP2, CP3 and spline interpolation. For simplicity, three control points are discussed in FIGS. 9-11, 14 & 15. More control points can be used, as shown by the sets of control points (plus marker, triangle marker, X marker) shown in FIGS. 16 & 17. A spline curve is generated by first selecting control points. A spline curve is interpolated by passing a curve through the control points. In the illustrated example, this forms a first line CP1CP3 and a second line CP3CP2. This is opposed to approximating a spline curve, where the curve passes near the control points, but not necessarily through them. The at least two spline curves of the transition zone of the addendum A1 are interpolated to add and remove material until an optimized blade profile is achievable by stitching the interpolated spline curves together. Stitching can comprise joining the different segments of the spline curves together. For example, line CP1CP3 is joined to CP3CP2 to form line CP1CP3CP2 (or CP1CP2 in shorthand). In the examples using sets of control points, a first line is formed interpolating the plus mark control points together to form a first spline curve S1, and then the triangle mark control points are interpolated to form a second spline curve S2. The first spline curve S1 is stitched to the second spline curve S2 by joining the two curves at a chosen control point, such as control point CP3. The resulting blade profile has curve attributes of both first and second spline curves S1, S2. Some of the control points from the sets of control points are discarded, because they are not stitched in, but they nevertheless direct the slope of the affiliated spline curve and influence the resulting stitched spline curve blade profile.

Because at least the first control point CP1 can occur within the addendum, but not necessarily at the terminus of the addendum A1, the addendum A1 comprises a transition zone TZ1. The transition zone TZ1 includes the interpolated spline curves S1, S2. A first spline curve S1 is chosen to remove a portion of material at the transition zone TZ1 to avoid rotor-to-rotor contact as the blades rotate. However, removing too much material, as by extending the first spline curve S1 along the entire transition zone TZ1, causes excessive leakage of fluid in the Roots device. Thus, a second spline curve S2 is applied to the cycloid profile to build up the amount of material in the transition zone TZ1. The built up material prevents leakage of fluid in the gap between rotor blades. The second spline curve S2 also gives uniformity to clearance results so that it is possible to maintain a smaller and more uniform gap between the rotors. This can be seen in FIG. 6, where a specified spacing between rotors is maintained with a 12 micron clearance as the rotors rotate in the housing. Compared to the prior art clearance, which varies 180 microns, the two spline curve design has a more uniform clearance profile.

Unlike prior art, that uses a simple radius on a uniform arc, the first and second spline curves S1 & S2 are derived using control points and interpolation. The curves are thus more complex than the prior art. Also, while the prior art seeks to remove material, only, the applied methodology of this disclosure combines a removal and build-up process to the cycloid profile.

Figure 12:
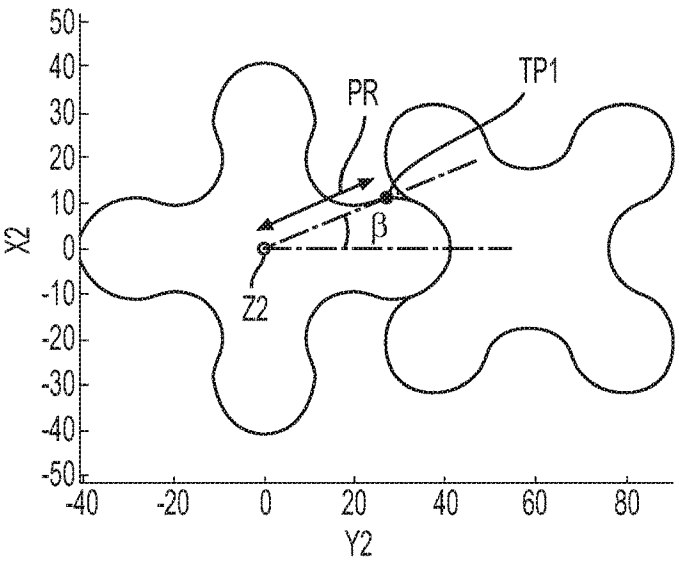

Turning to FIG. 12, a pitch radius PR is overlaid on the rotor profile. The pitch radius PR is one half of the pitch diameter. Pitch diameter is discussed in U.S. Pat. No. 7,488,164, assigned to the assignee of the instant application. At the midpoint of the pitch diameter, at the intersection of the pitch radius and the blade profile, a terminus point TP1 of the addendum A1 is located. An addendum angle beta (β) extends from a vertex at the length axis Z2. The addendum angle beta (β), in the illustration, is equal to pi/8 or "π/8," because there are 4 lobes. For other rotor designs, beta (β) is equal to pi divided by two times the number of lobes. The addendum A1 extends within the addendum angle beta (β).

With the addendum A1 starting point determined using the addendum angle beta (β), an initial cycloid curve, which is convex, extends from the concave undercut U1 to the tip T1. The cycloid curve is then modified via spline curve interpolation.

Figure 14:
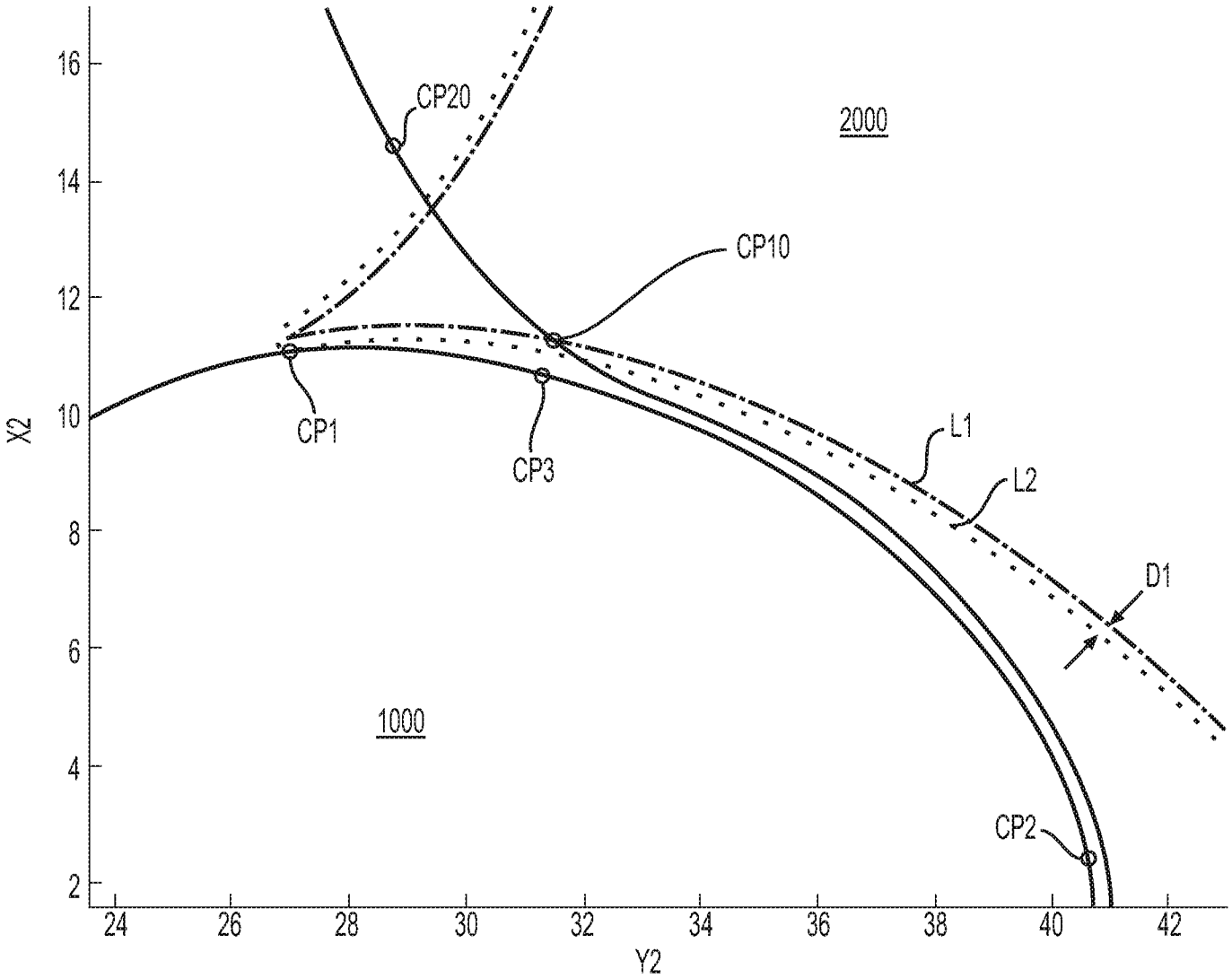

The first control point CP1 is selected as shown in FIG. 14. Rotor 1000 is distanced from rotor 2000 by a gap, or clearance, having a distance D1. The clearance limits rotor-to-rotor contact when the device experiences temperature fluctuations, or as the device flexes or vibrates under load. The clearance is selected for a particular application in light of various parameters, such as volumetric efficiency, operating temperatures, materials selections, pressure ratios, etc. The distance D1 of the gap can be converted, conceptually, in to the diameter of a circle C1. The circle C1 is tangent to the addendum A1. The first control point CP1 can be laid anywhere on the circle C1. The midpoint M of the circle is the midpoint of the rotor-to-rotor clearance. With the first control point CP1 placed with respect to circle C1, A spline curve can be passed through the first control point CP1 in the direction of the third control point CP3. Third control point CP3 can be at the intersection of blade profile with the arc of the included angle α that forms the tip T1 boundaries. The third control point CP3 is inserted between the first and second control points CP1 & CP2, and the first and third spline curves S1, S3 are stitched together after being interpolated to the control points. More control points can be used to add complexity to the addendum A1 profile. More than two spline curves can be interpolated to the control points and the various spline curves can be stitched together to form the addendum profile in the transition zone TZ. Spline curves can span a portion or all of the addendum. The blade profile can be modified by additively stitching together spline curves, so that the resultant profile spans all or a portion of the addendum. So, the convex cycloid curve of the addendum can be partially or wholly modified by spline curve interpolation and stitching.

The additional control points and spline curves can be selected by extending the imaginary circle concept of FIG. 13, as depicted in FIG. 14. The extension provides a boundary for limiting rotor-to-rotor contact. Since the rotor blade profiles have mirror images about their respective length axis Y2, and since the same rotor profile can be applied to all of the rotor blades in a rotor pair, a corresponding first control point CP10 and corresponding second control point CP20 are located on the right hand rotor 2000 in like places as the first control point CP1 and second control point CP2 of the left hand rotor 1000. Offsetting the right hand rotor first control point CP10 by the clearance distance D1, and tracing the relative motion of the right hand rotor with respect to the left hand rotor, yields an offset locus L2 of the first control point CP10 of the right hand rotor. The offset locus L2 provides a boundary for locating control points affiliated with the left hand rotor 1000. Locus L1 is the set of points tracing the actual relative motion of the first control point CP10 of the right hand rotor with respect to the left hand rotor. All left hand rotor control points are on or below the offset locus L2. Generating the offset locus L2 can comprise tracing the relative motion of the first control point CP10 of the right hand rotor, as it rolls over a pitch cylinder of the stationary left hand rotor.

Figure 15:
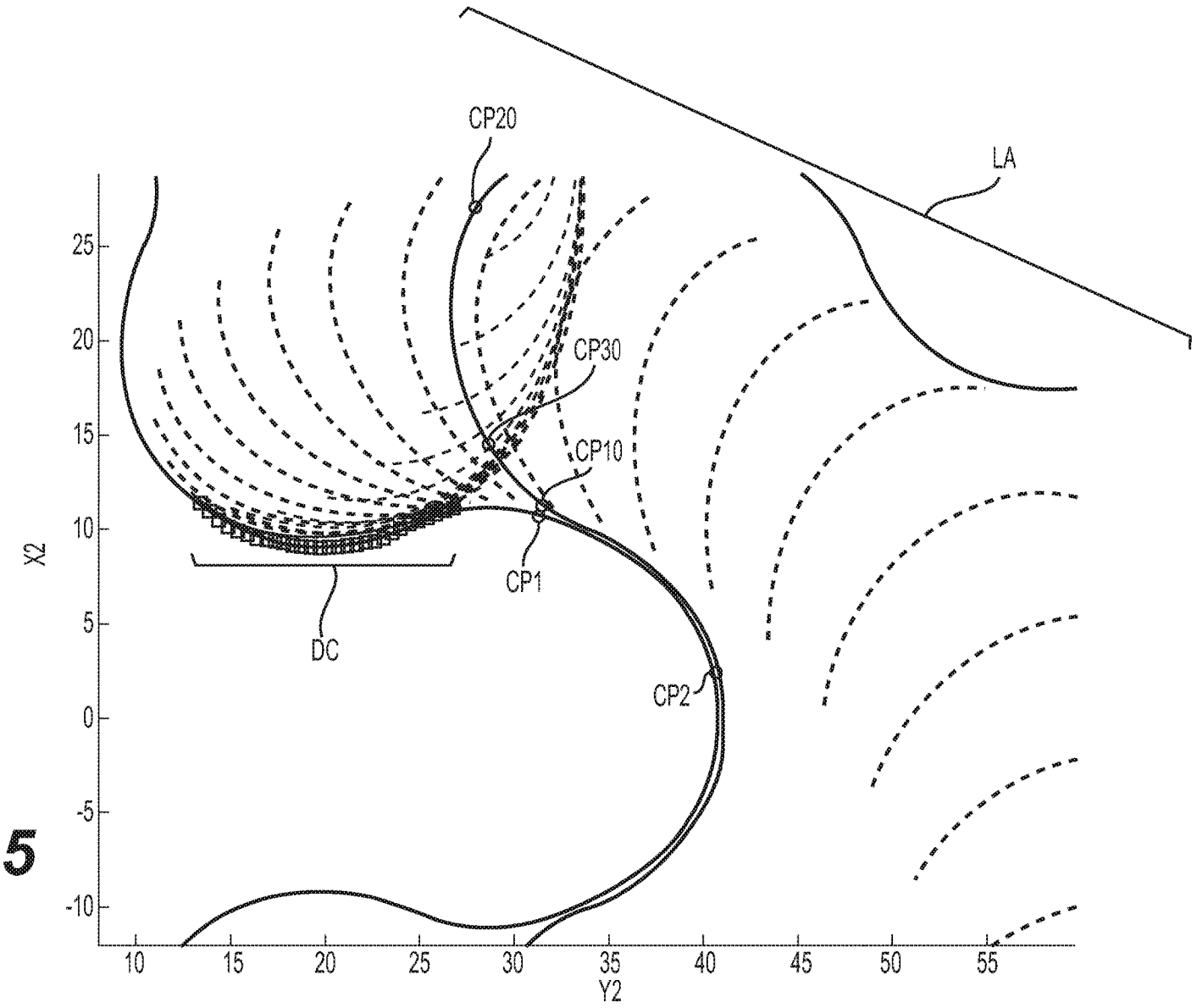

FIG. 15 shows the many loci of the right hand rotor's addendum as it rotates relative to the stationary left hand rotor. The loci of the addendum are shown in dashed lines.

The undercut U1 is generated as a conjugate profile of the addendum A1. Outlining the relative motion of the right hand rotor addendum profile as it rolls over the pitch cylinder of the stationary left hand rotor forms a convex dedendum DC. The same offset distance D1 is used. The dedendum DC is a mirror image of the addendum A1, and can thus comprise a set of control points, illustrated in FIG. 15 as a series of square marks. The undercut U1 thus also comprises at least two spline curves. The use of mirror images also makes it possible to maintain uniform rotor-to-rotor clearance at all points of the addendum and dedendum.

Further optimization and smoothing can be done to the profile to keep the gap between rotors to a minimum. This reduces the volume of fluid trapped between the rotors, which reduces leakage of fluid. As discussed with respect to FIGS. 7 & 8, the leakage path length is also reduced.

Figure 16:
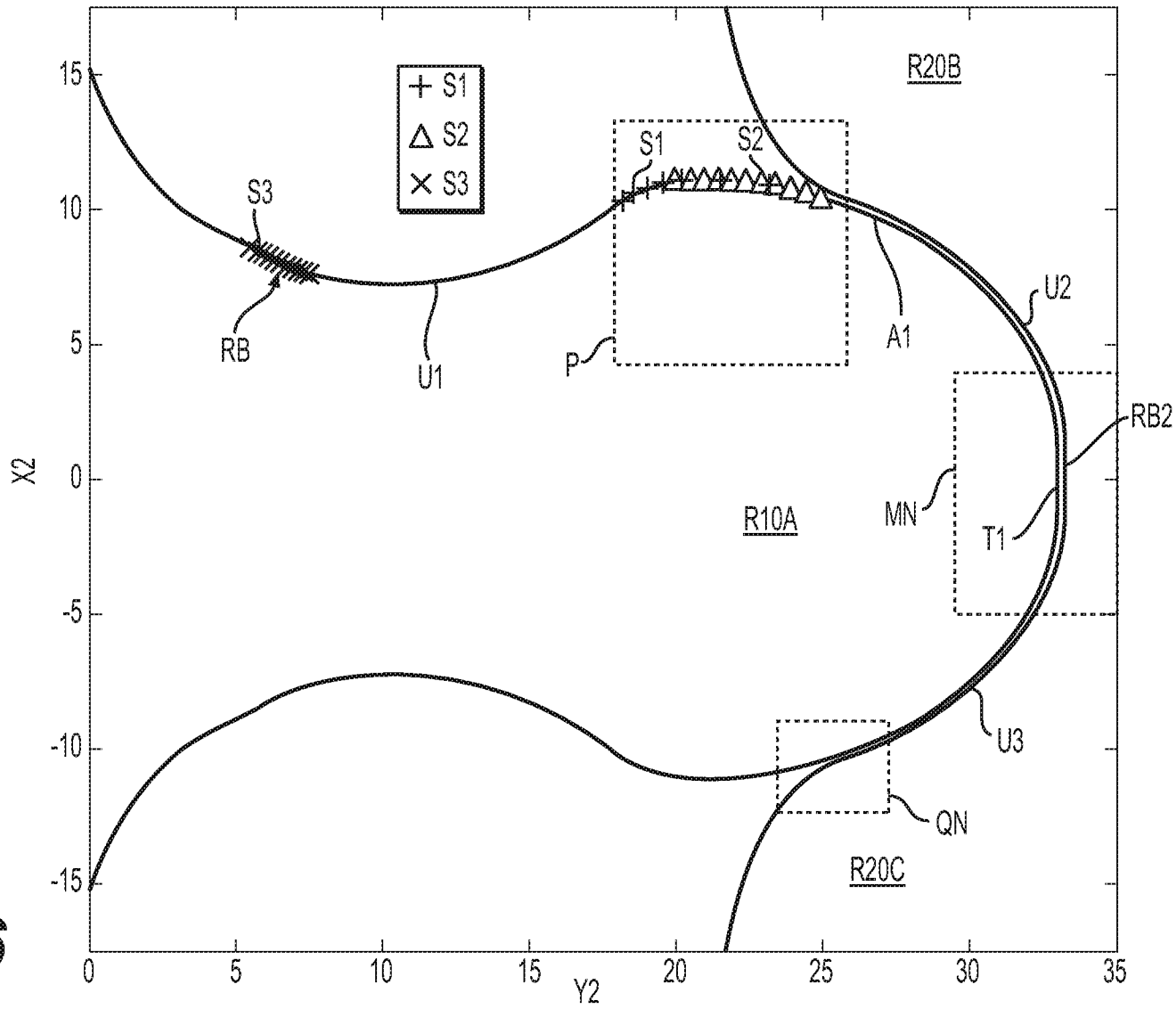

FIG. 16 shows the spline curves S1, S2, S3 interpolated on rotor R10A. The root base RB can comprise a third spline curve S3. Sections MN, P & QN are indicated, and will be discussed with respect to FIGS. 17-25. A right hand root base RB2 is shown between the undercut U2 of rotor R20B and the undercut U3 of rotor R20C.

Figure 17:
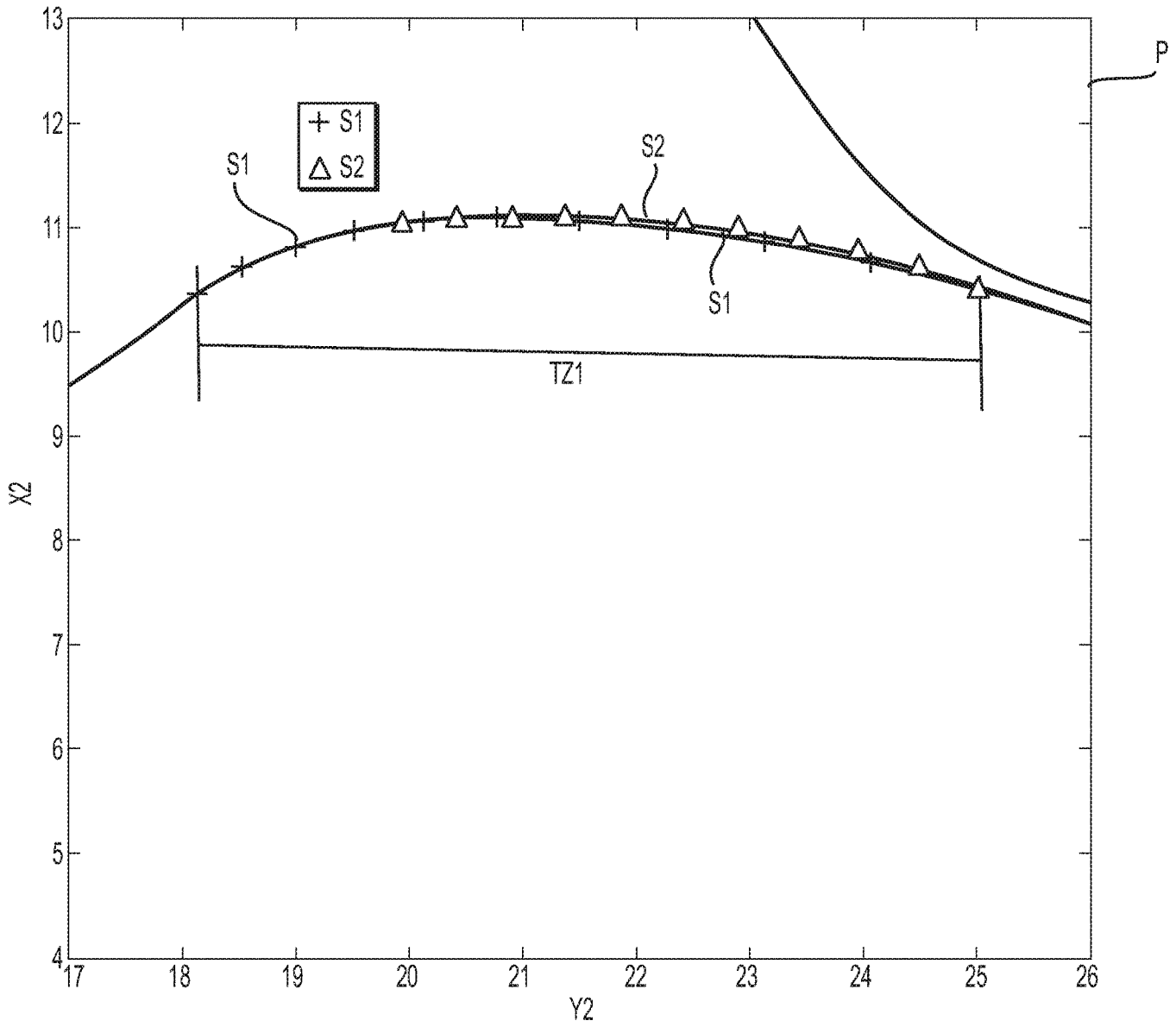

FIG. 17 is an enlarged view of area P of FIG. 16. The transition zone of addendum A1 is shown with two spline curves S1 and S2. The control points for the first spline curve S1 are shown as plus (+) signs. The control points for the second spline curve are shown as triangles (Δ). If S1 extended for the full transition zone TZ1, then too much material would be removed from the blade profile. So, the second spline curve S2 adds material to the blade profile to ensure uniform clearance as the rotors rotate. The end result is a combination of the two spline curves S1, S2.

Figure 18:
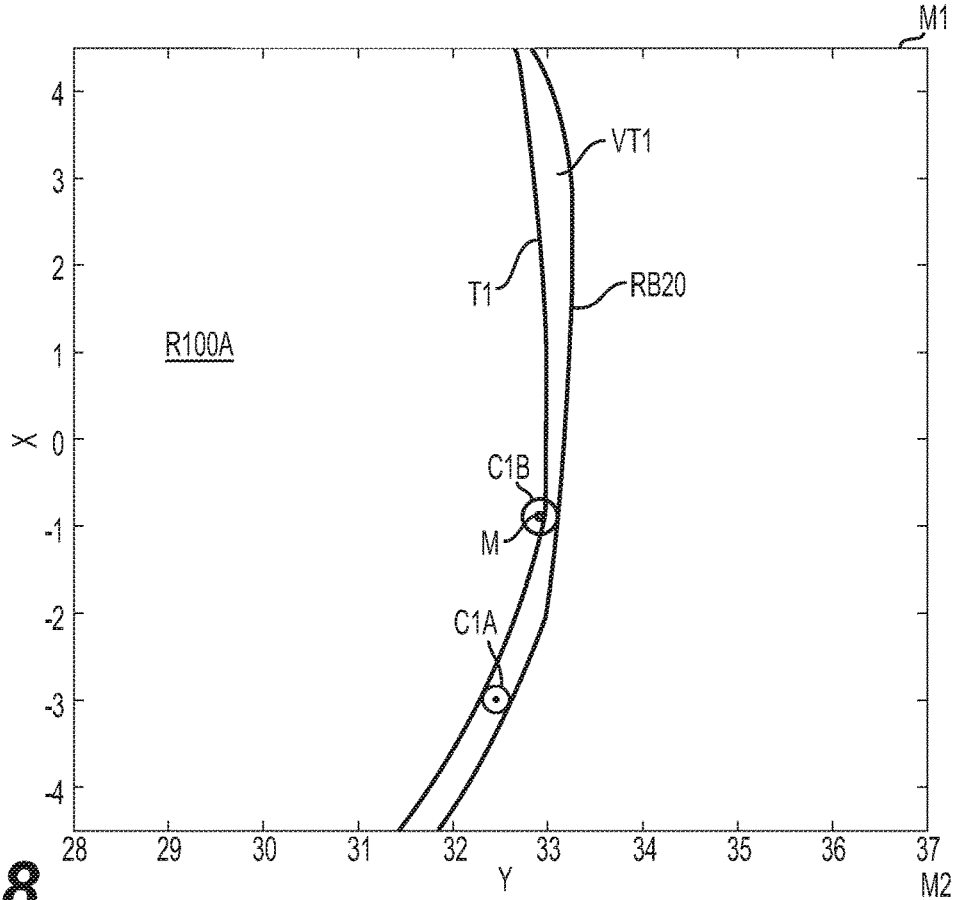
Figure 19:
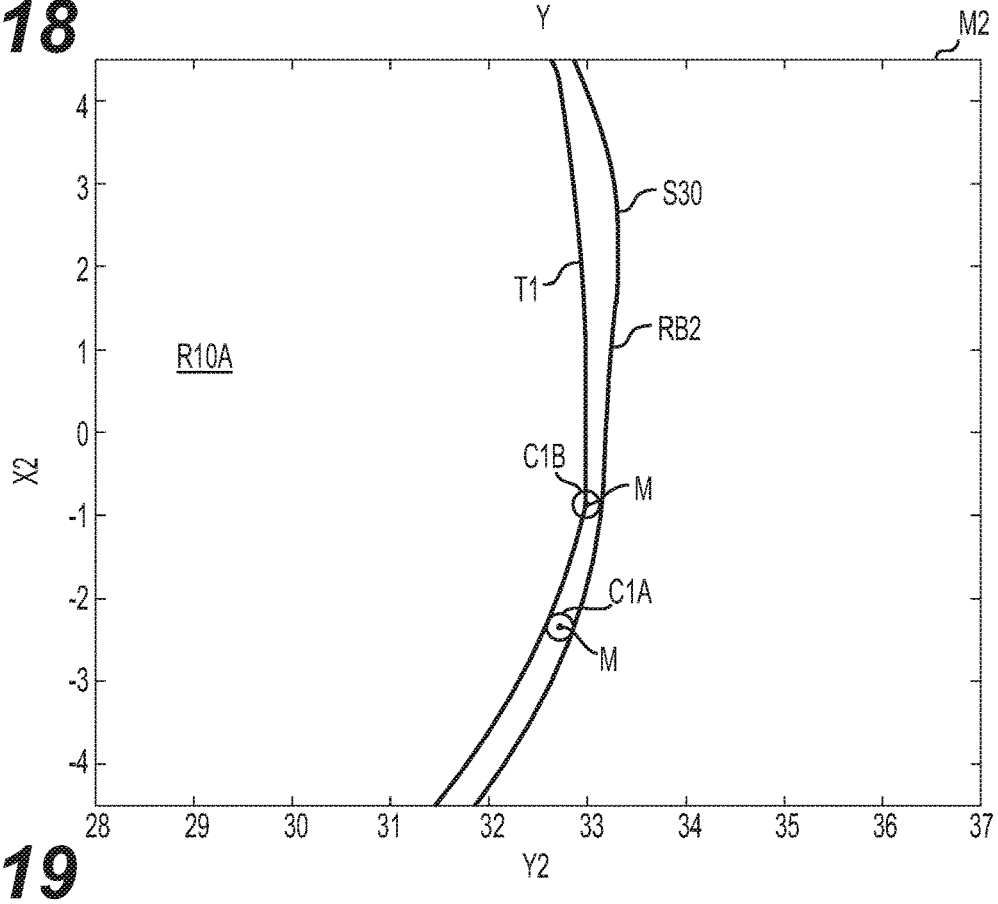
Figure 20:
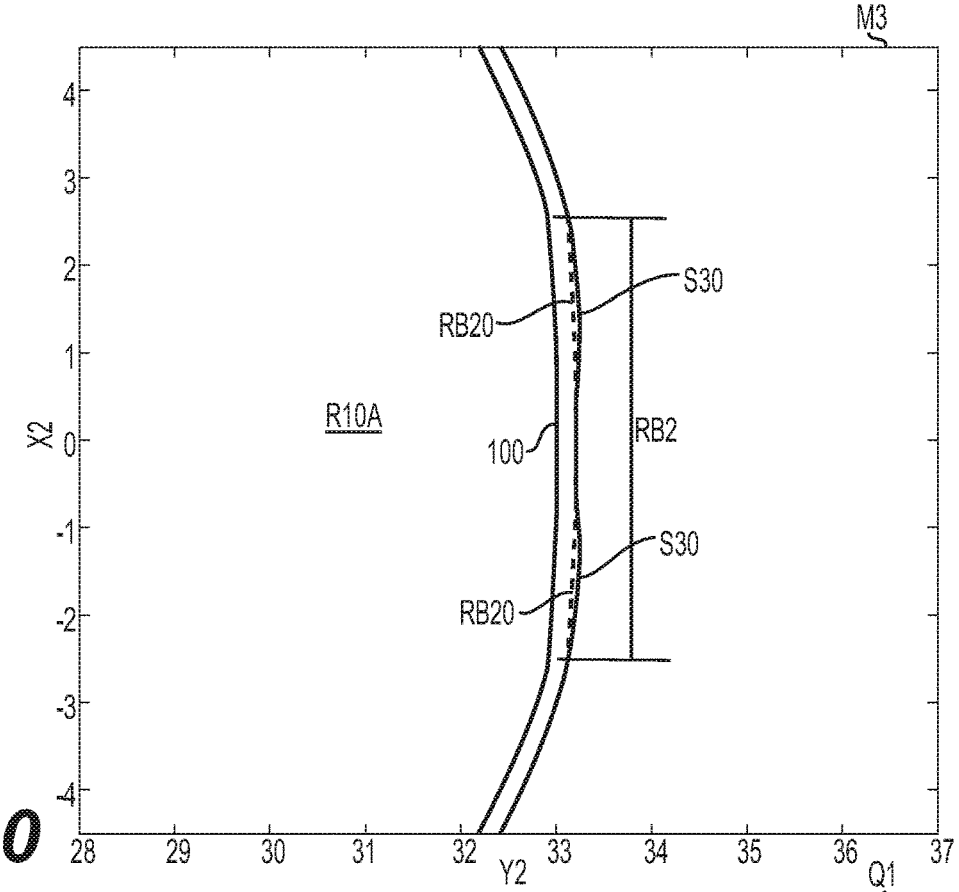

FIGS. 18-20 are views of area MN of FIG. 16, but instructive modifications are made to area MN to result in the views M1, M2, M3 of FIGS. 18-20.

In FIG. 18, a third spline curve S30 has not been interpolated, so view M1 shows a flat root base RB20 that mirrors tip T1. Rotor R10A is also slightly rotated. As shown, the flattened tip T1 is too close to the flat root base RB20, and a non-uniform gap creates a trapped volume VT1. A uniform clearance cannot be maintained. The clearance of circle C1A is within the parameters of FIG. 6 when the addendum includes the two spline curves S1 and S2. But, the clearance of circle C1B is outside desired range, because third spline curve S3 is not applied. Having over-reached midpoint M, heat expansion and other tolerance issues can result in the tip T1 touching the root base RB20 along contact length CL2. The trapped volume is squeezed as the rotor rotates, and the trapped volume VT1 leaks backwards, from outlet to inlet, along the leakage length, which tracks the contact length CL2.

FIG. 19 includes, in view M2, the interpolated third spline curve S30 to form root base RB2. The tip T1 does not pass midpoint M of circle C1B, so contact issues are ameliorated or avoided, and the clearance between tip T1 and root base RB2 is within the desired average shown in FIG. 6. With diameter of C1B equal to C1A, the nominal clearance and actual clearance are improved over the prior art. Since contact can be a relative spacing issue, there is said to be rotor-to-rotor contact, resulting in a profile for contact length CL20. However, reducing the trapped volume and reducing the contact length CL20 improves the volumetric efficiency, and the rotor blade profile improves over the prior art.

FIG. 20 includes dashed lines to show where root base RB20 would be without use of spline curve S30. Root base RB2 is thus not a mirror image of the rotor tip T1 in view M3.

Turning to the next area of interest QN, FIGS. 21-24 are views of the area QN of FIG. 16, but with instructive modifications to show the benefits of the disclosed blade profile, resulting in the views Q1-Q4.

An edge can be applied to each rotor blade to form the flattened tip T1. The flattened tip T1 does not have to be perfectly flat, and can be rounded with a large radius. The flattened tip permits uniform clearance results between the blades and the housing as the blades sweep fluid internally from inlet to outlet. However, the flattened tip T1 can contact the undercut of the mating rotor if a large rotor spacing is not maintained. Since it is desirable to avoid a large gap between rotors, a further adjustment is made at the root base of the blades. At the root base of each blade, a third spline curve S3 is added to receive the flattened tip of the mating blade. The third spline curve S3 permits a closer spacing of the rotors to minimize the backwards leaking of fluid and to increase the efficiency of the Roots device.

The flattened tip T1 reduces the rotor-to-housing leakage in the hybrid profile. The spacing between the rotors and the housing can be optimized in a similar way to reduce the overall packaging space, which reduces the space for backwards leakage. The flattened tip T1 permits the rotors to be closer to the housing walls than a non-flattened, non-optimized blade profile tip The flattened tip T1 permits a high resistance to leakage. Otherwise, non-uniform leakage would occur if only the cycloid profile were maintained at that location.

Figure 21:
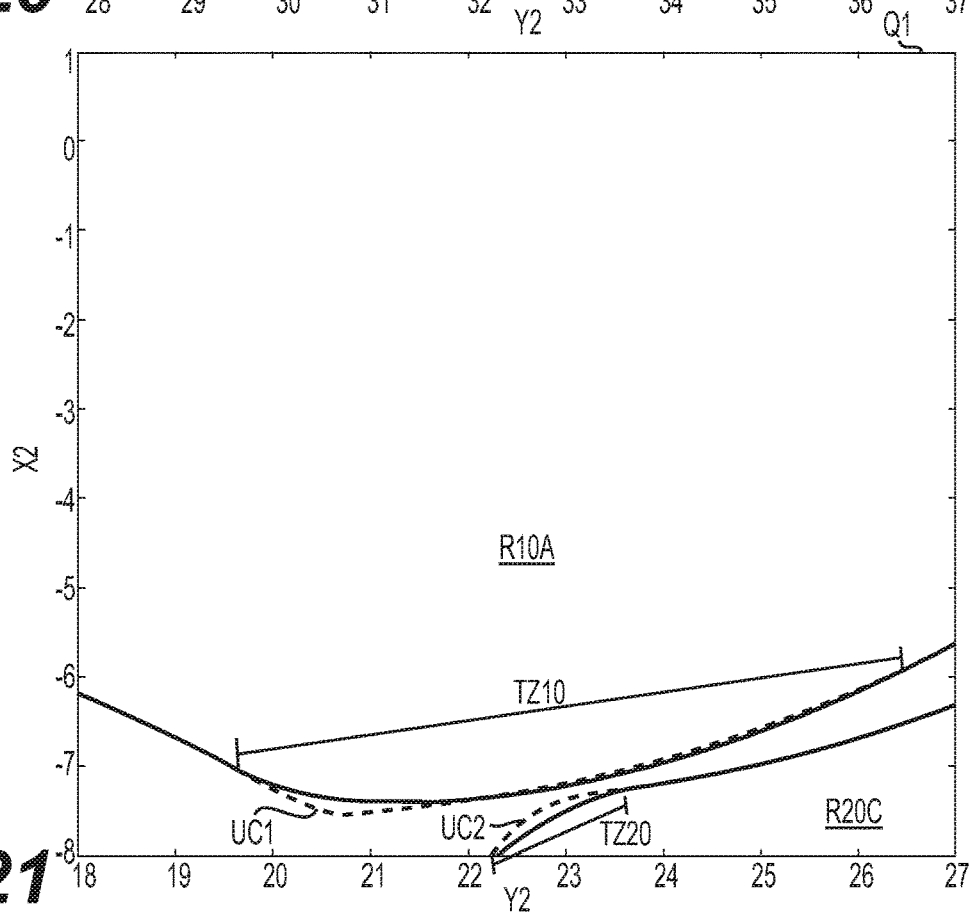

FIG. 21 shows a modified view Q1, where rotor R10A is rotated with respect to rotor R20C by ten degrees. The dashed lines show uncorrected cycloid profiles UC1, UC2. The transition zones TZ10, TZ20 include interpolated and stitched spline curves to form the solid lines. The uncorrected cycloid profile UC1 would cause a tight and non-uniform gap at the illustrated rotor spacing.

Figure 22:
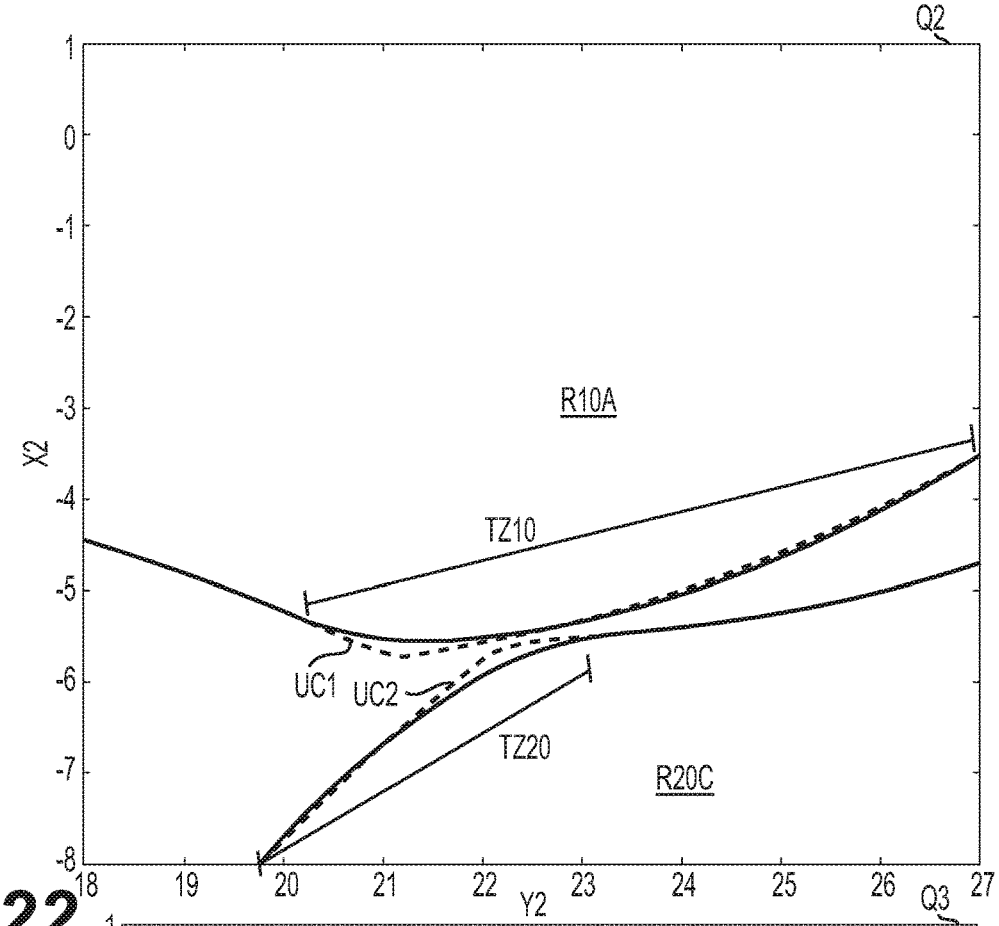

FIG. 22 shows a modified view Q2, where rotor R10A is rotated with respect to rotor R20C by 15 degrees. The dashed lines show uncorrected cycloid profiles UC1, IC2. The transition zones TZ10, TZ20 include interpolated and stitched spline curves to form the solid lines. The uncorrected cycloid profiles UC1, UC2 are near-touching.

Figure 23:
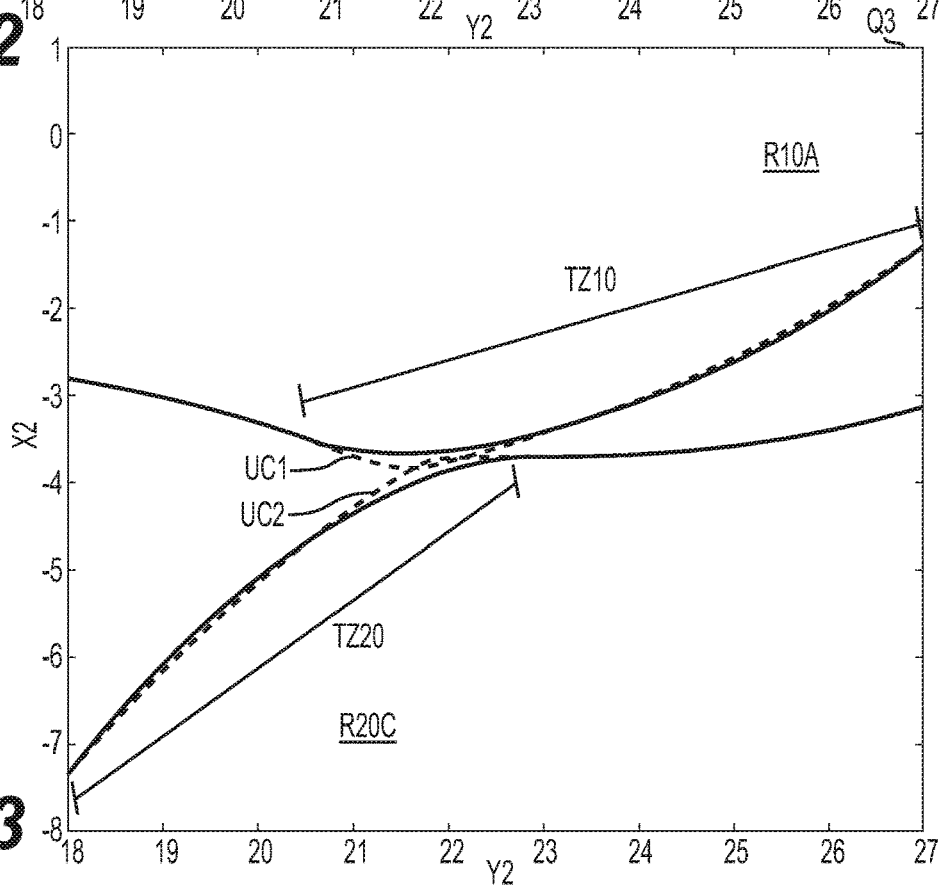
Figure 24:
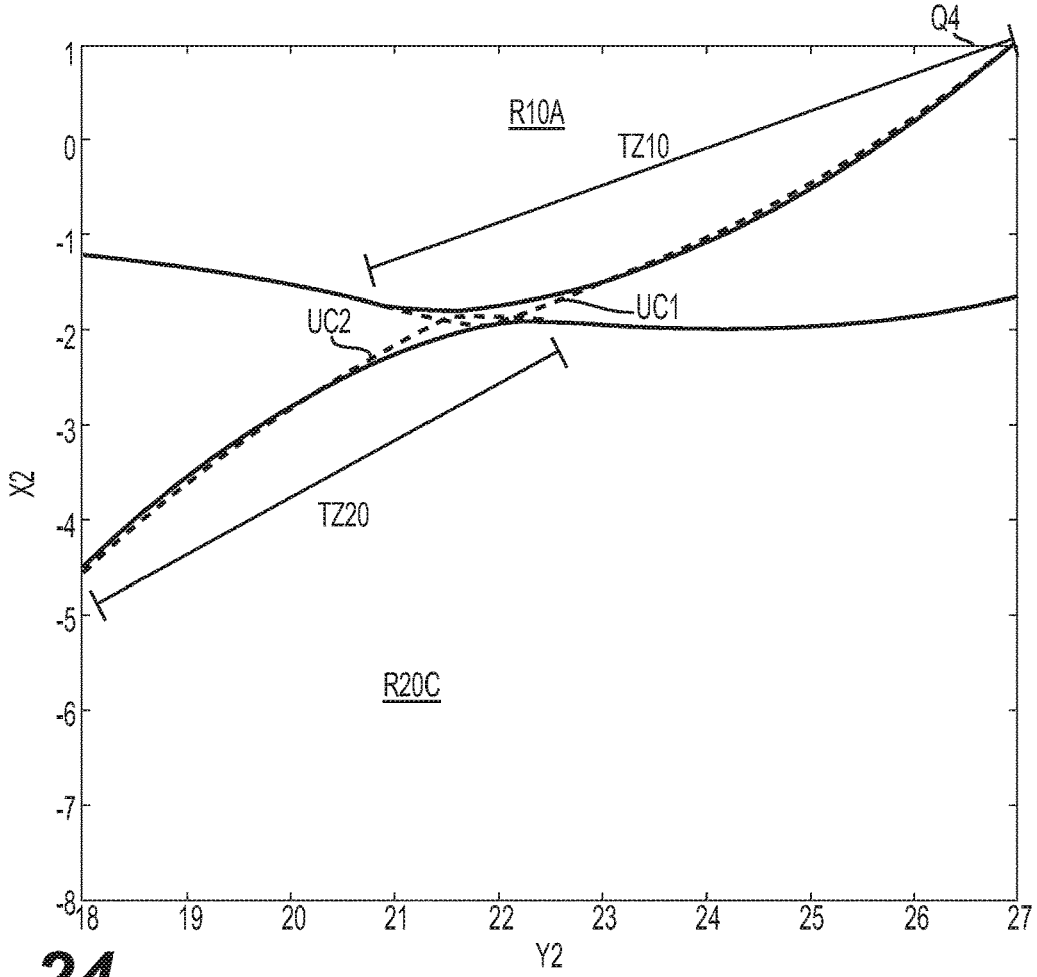

FIG. 23 shows the modified view Q3, where the rotor R10A is rotated with respect to rotor R20C by 20 degrees. The uncorrected cycloid profiles UC1, UC2 contact at this spacing, while the blade profiles having the interpolated and stitched spline curves applied to the rotors R10A & R20C do not contact. FIG. 24 shows the modified view Q4, where the rotor R10A is rotated with respect to rotor R20C by 30 degrees. The uncorrected cycloid profiles UC1, UC2 overlap at this spacing, while the blade profiles having the interpolated and stitched spline curves applied to the rotors R10A & R20C do not overlap. So, using the interpolated a stitched spline curves definitively permit tighter packaging and smaller clearances.

Figure 25:
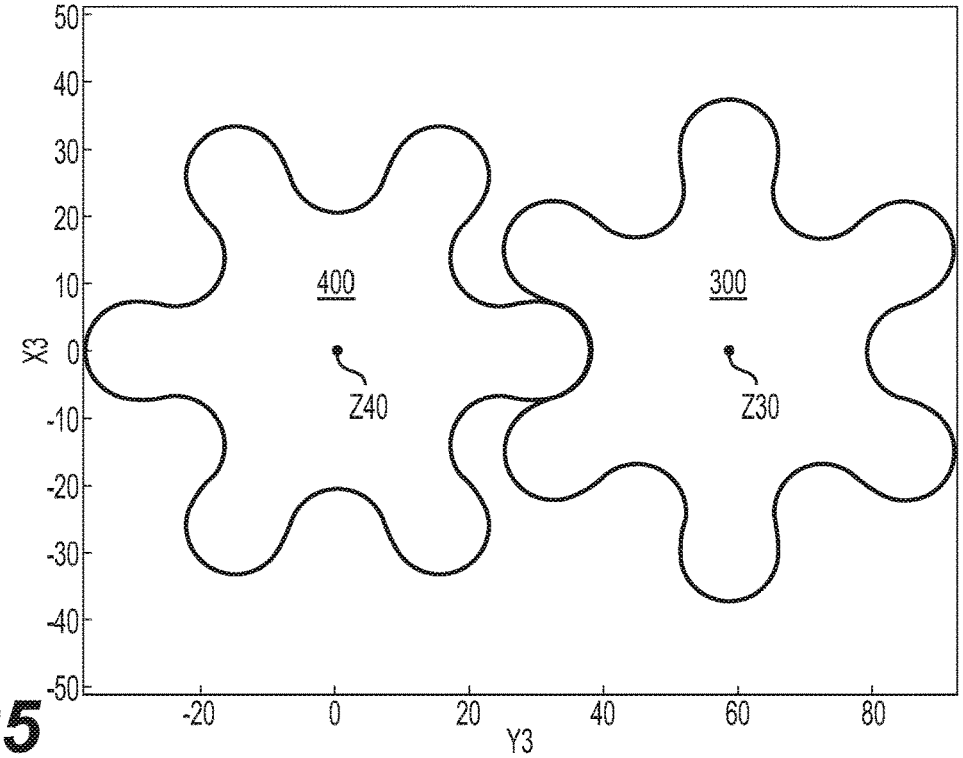
FIG. 25 shows a 6-lobed pair of hybrid profile rotors.

FIG. 25 illustrates a pair of 6-lobed rotors 400, 300, with length axis Z40 & Z30. Being able to package the rotors closer together and with smaller clearances permits expanded opportunities to use 5+ lobed rotors. The improved blade profiles inure improved high speed isentropic efficiency, improved pressure ratio capability, and reduced NVH (noise, vibration, harshness) while maintaining good volumetric leakage values.

By imparting each cycloid blade with two spline curves, and by imparting the root of the rotor with a third spline curve, it is possible to reduce the gap between rotors 1000, 2000. This can be seen by comparing FIGS. 5 & 6 and by comparing FIGS. 7-8.

As above, the contact between the rotors is reduced, and so the contact length CL20 reduces using the hybrid profile blade. The sealing width SW20 is the length of the rotor profile curve where the actual clearance between the rotors is less than some fraction of the nominal gap, for example, two times the nominal gap. If the actual clearance is less than this fraction of the nominal gap, the rotors are said to "seal" at that location. The prior art sealing width SW2 is shown in FIG. 3B, while FIG. 4B shows the improved sealing width SW20 of the hybrid profile blade.

In the prior art, a gap, or fluid space, occurred and varied in size between rotors when the blades meshed. An example of 180 microns of possible gap depending upon the angular position of the blade in the pocket P2 is shown. FIG. 1 shows a volume of fluid trapped in an involute portion of rotor R2B. Fluid in this space can be squeezed out along the length of the rotor to leak between the rotor end face and the housing, causing a loss of volumetric efficiency.

For a comparably sized supercharger having rotors 1000 & 2000, no trapped volume is shown in FIG. 2. FIG. 6 shows a possible clearance variation of 12 microns between rotors at the center of the Roots device. Thus, using the hybrid profile, a user can select a predetermined clearance between the rotors, for example 180-190 microns, to limit chatter or allow for heat expansion. And this selected clearance can be maintained within 12 microns, instead of the prior art result of having to double the space between rotors to avoid rotor contact. The fluid response across the angular position is more uniform than the prior art due to the reduction in fluid entrapment areas. There is also less fluid leakage. The supercharger's volumetric efficiency is improved.

Figure 4A:
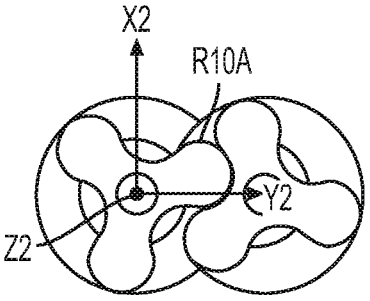
FIGS. 4A-4D are additional views detailing hybrid blade profile supercharger rotors.
Figure 4B:
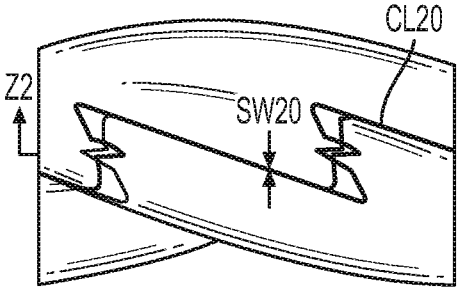
Figure 4C:
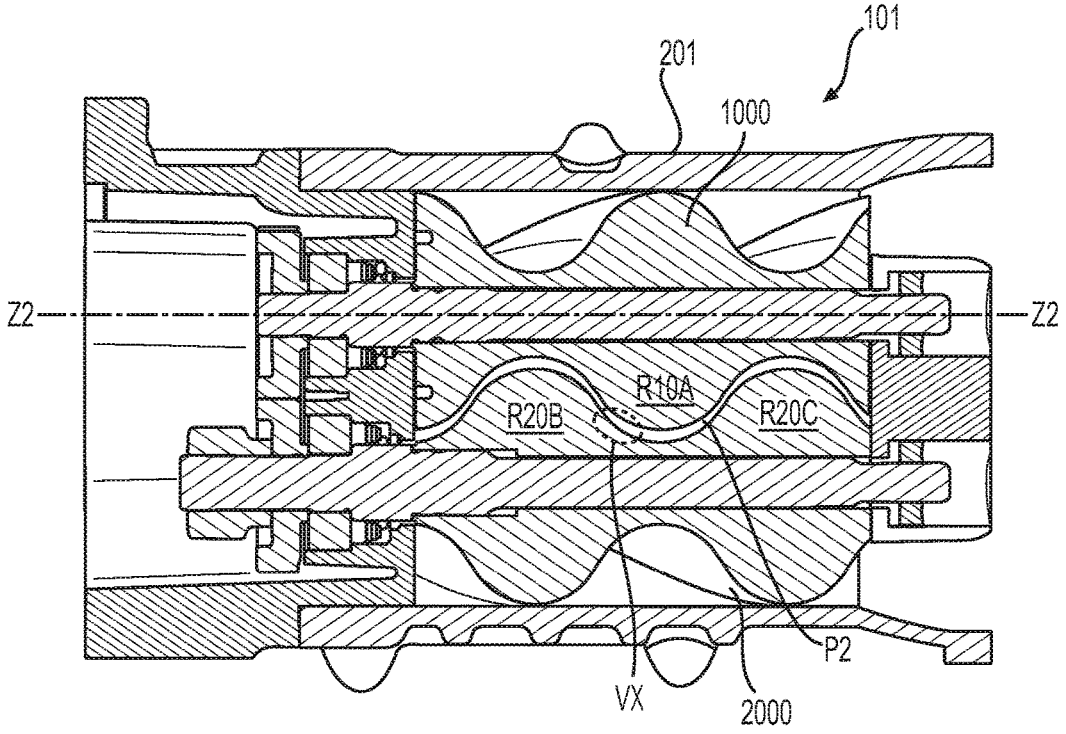
Figure 4D:
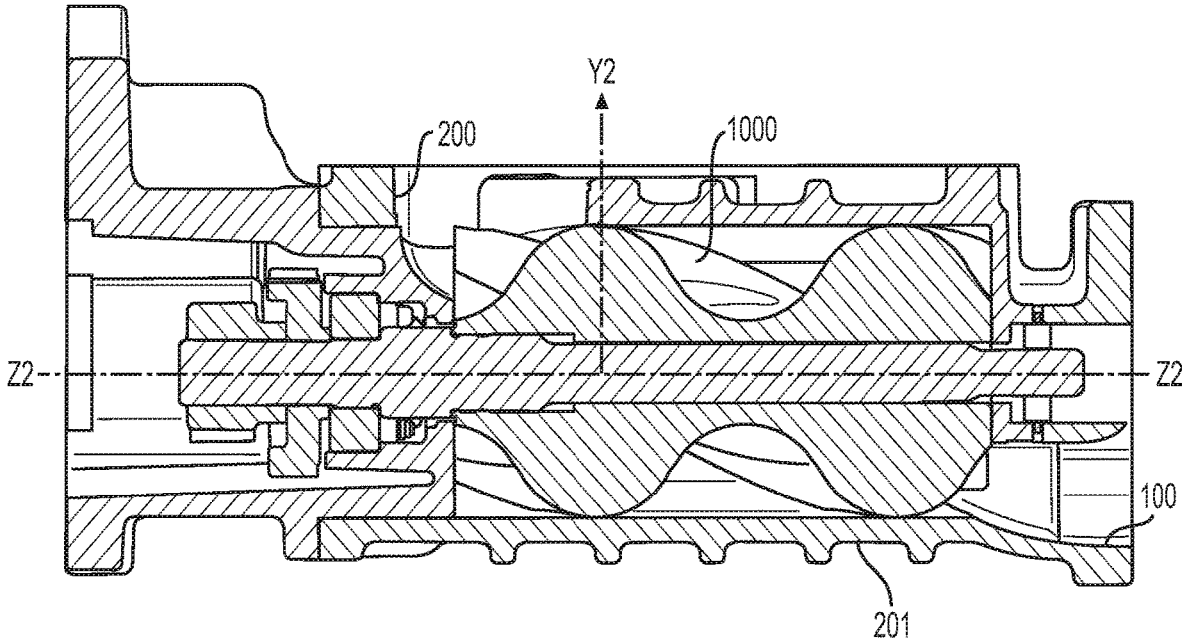
Figure 7:
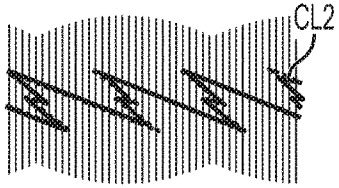
FIG. 7 is a chart for involute rotors.
Figure 7:
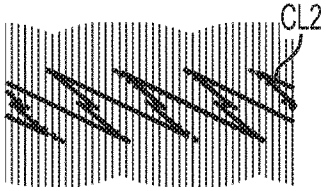
Figure 7:
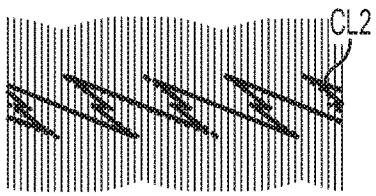
Figure 8:
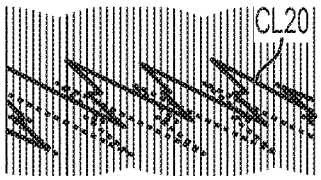
FIG. 8 is a chart for hybrid profile rotors.
Figure 8:
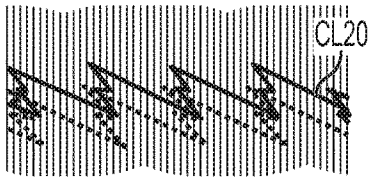

Another improvement is seen comparing FIGS. 3B & 4B, where a rotor-to-rotor contact length is reduced by 27% over the prior art. The hybrid profile blades reduce contact length by minimizing the trapped volume when the rotors mesh. Additional examples are shown in FIGS. 7 & 8. FIG. 7 shows examples of involute blade profile supercharger rotors packaged to provide 726 cc of displacement. The involute blades are twisted with a selected helix angle and are packaged at the listed center distances in millimeters. As above, the leakage of the lobes is tied to the contact length CL20, and the leakage length can have the same value as the contact length. The rotor-to-rotor leakage length, in millimeters, increases with increasing center distance and with increasing the number of lobes from four to five. FIG. 8 shows an improvement to rotor-to-rotor leakage length using the disclosed hybrid blade profile. The reductions in leakage results in improved isentropic efficiency, lower noise, higher pressure ratio capabilities and maintained volumetric efficiency. Spacing the rotors is a function of keeping the fluid space between rotors to a minimum to limit leakage, yet having a sealing width between rotors of sufficient resistance to fluid flow.

Other implementations will be apparent to those skilled in the art from consideration of the specification and practice of the examples disclosed herein. For example, other dimensions for spacing and displacement are contemplated such that the numerical values shown for clearances, center distances, and displacements, are not limiting. But, the variation in actual clearance can be a percentage, as claimed and described, of the implemented clearances.

What is claimed is:

1. A pump rotor blade comprising:
a concave undercut;
a tip;
a convex addendum between the concave undercut and the tip, the convex addendum comprising;
a cycloid curve; and
a transition zone, the transition zone comprising:
a first spline curve; and
a second spline curve interpolated and stitched together with the first spline curve,
wherein the first spline curve removes material from the rotor blade profile in the transition zone, while the second spline curve adds material to the rotor blade profile in the transition zone.

2. A pump rotor blade of claim 1, wherein the concave undercut comprises a dedendum comprising at least a third spline curve and a fourth spline curve that are interpolated and stitched together to comprise a mirror image of the transition zone.

3. A supercharger rotor comprising a plurality of lobes around a center axis, each lobe of the plurality of lobes comprising a rotor profile, the rotor profile comprising:
a tip;
an undercut region;
a root base; and
an addendum comprising a convex cycloid curve comprising a transition zone, the transition zone comprising:
a first spline curve and a second spline curve interpolated and stitched together,
wherein the first spline curve removes material from the rotor profile while the second spline curve adds material to the rotor profile,
wherein the root base is positioned adjacent the center axis, and
wherein the rotor profile is arranged from the root base, to the undercut region, to the addendum, to the tip.

4. The supercharger rotor of claim 3, wherein the undercut region comprises a dedendum comprising a mirror image of the convex addendum.

5. The supercharger rotor of claim 3, wherein the root base comprises a third spline curve removing material from the rotor profile.

6. The supercharger rotor of claim 3, wherein the tip extends for a distance enclosed by a circular arc of an angle $\alpha$, and wherein the root base also extends for a distance enclosed by a second circular arc of the angle $\alpha$.

7. The supercharger rotor of claim 3, wherein the tip is flattened.

8. The supercharger rotor of claim 3, wherein the plurality of lobes comprise between 3 and 6 parallel lobes.

9. The supercharger rotor of claim 3, wherein the plurality of lobes comprise between 3 and 5 twisted lobes.

10. The supercharger rotor of claim 3, wherein the interpolated and stitched first spline curve and second spline curve span between a first control point and a second control point, wherein the first control point is at a pitch diameter between adjoining lobes of the plurality of lobes, and wherein the second control point is on the tip.

11. The supercharger rotor of claim 3, wherein the first spline curve is formed of a set of control points, and wherein one or more of the control points of the set of control points is discarded from the rotor profile when the first spline curve and the second spline curve are stitched together.

12. A supercharger, comprising:
a first rotor comprising a plurality of lobes and a first long axis;
a second rotor comprising a plurality of lobes and a second long axis;
each lobe of the plurality of lobes of the first rotor and of the second rotor comprising a rotor profile, the rotor profile comprising:
a tip;
a convex addendum comprising a transition zone, the transition zone comprising at least two spline curves that are interpolated and stitched together;
an undercut region; and
a root base, wherein a first one of the at least two spline curves removes material from the convex addendum, while a second one of the at least two spline curves adds material to the convex addendum, wherein the supercharger is configured to mesh the addendum of the first rotor with the undercut region of the second rotor and to mesh the tip of the first rotor with the root base of the second rotor.

13. The supercharger of claim 12, wherein the undercut region comprises a dedendum comprising a mirror image of the convex addendum.

14. The supercharger of claim 12, wherein the root base comprises a third spline curve.

15. The supercharger of claim 12, wherein the at least two spline curves are bounded by an imaginary locus formed by offsetting a first control point of the second rotor by a clearance distance, and by tracing the relative motion of the second rotor with respect to the first rotor.

16. The supercharger of claim 12, wherein the undercut region is generated as a conjugate profile of the addendum.

17. The supercharger of claim 16, wherein the undercut region comprises a dedendum formed by outlining the relative motion of the second rotor addendum profile as it rolls over a pitch cylinder of the first rotor.

18. The supercharger of claim 12, wherein the undercut region comprises at least two interpolated and stitched spline curves.

19. The supercharger of claim 12, wherein each lobe of the plurality of lobes of the first rotor and of the second rotor are parallel to each other.

20. The supercharger of claim 12, wherein the first rotor is spaced from the second rotor by a rotor-to-rotor clearance that varies by less than 7% as the first rotor rotates relative to the second rotor.

21. The supercharger of claim 12, wherein a nominal gap between the first rotor and the second rotor varies by less than 3% as the first rotor rotates relative to the second rotor.

22. A multi-lobed rotor comprising a rotor blade profile applied to each of the multiple lobes, the rotor blade profile comprising:

a first spline curve interpolated with a second spline curve; and a cycloid curve stitched with the interpolated first spline curve and second spline curve, wherein the first spline curve comprises a first set of control points to result in a first slope, wherein the second spline curve comprises a second set of control points to result in a second slope, and the second slope is not the same as the first slope, and wherein stitching the interpolated first spline curve and second spline curve comprises discarding a first portion of the first set of control points, discarding a second portion of the second set of control points, and joining the first spline curve and the second spline curve so that the rotor blade profile has attributes of both the first spline curve and the second spline curve.

23. The multi-lobed rotor of claim 22, wherein the rotor blade profile further comprises a concave undercut, a tip, and a transition zone between the concave undercut and the tip, and wherein the first spline curve removes material from the rotor blade profile in the transition zone, while the second spline curve adds material to the rotor blade profile in the transition zone.

24. The multi-lobed rotor of claim 22, wherein the rotor blade profile further comprises a root base, and the root base is formed by removing material from the rotor blade profile according to a third spline curve.

* * * * *